US006716006B2

(12) United States Patent
Yang

(10) Patent No.: US 6,716,006 B2
(45) Date of Patent: Apr. 6, 2004

(54) TELESCOPIC DUAL MOVEMENT PUMP

(76) Inventor: Hsi-Kung Yang, No. 24, Lane 65, San Chun St., Shu Lin Chen, Taipei Hsien (TW)

( * ) Notice: Subject to any disclaimer, the term of this patent is extended or adjusted under 35 U.S.C. 154(b) by 19 days.

(21) Appl. No.: 10/173,065

(22) Filed: Jun. 17, 2002

(65) Prior Publication Data

US 2003/0231970 A1 Dec. 18, 2003

(51) Int. Cl.[7] ..... F04B 1/00
(52) U.S. Cl. ..... 417/528; 417/454; 417/259
(58) Field of Search ..... 417/528, 524, 417/526, 553, 555.1, 454, 313, 251, 253, 259, 263, 460, 469

(56) References Cited

U.S. PATENT DOCUMENTS 4,508,490 A * 4/1985 Ramirez et al. ..... 417/234
5,443,370 A * 8/1995 Wang ..... 417/238
5,560,520 A * 10/1996 Grogen ..... 222/321.2
5,873,705 A * 2/1999 Chen ..... 417/259
6,027,319 A * 2/2000 Winefordner et al. ..... 417/440

* cited by examiner

*Primary Examiner*—Justine R. Yu
*Assistant Examiner*—Han L Liu
(74) *Attorney, Agent, or Firm*—William E. Pelton, Esq.

(57) ABSTRACT

A telescopic dual movement pump has a nozzle assembly, a central tube connected to the nozzle assembly, a first tube enclosing the central tube and slidable relative to the central tube and a second tube enclosing the first tube and slidable to the first tube. The central tube has a first piston assembly which includes a block slidably received in the first tube. The first tube has an end provided with a second piston assembly which includes a second block slidably received in the second tube. The movement of the block and the second block in two opposite directions is able to force air inside the pump to be ejected out of the pump.

13 Claims, 5 Drawing Sheets

TELESCOPIC DUAL MOVEMENT PUMP

BACKGROUND OF THE INVENTION

1. Field of the Invention

The present invention relates to a pump, and more particularly to a telescopic dual movement pump that is able to pump air outward in movements in two opposite directions. Further, the tubes of the pump are telescopic so that the size is compact for storage.

2. Description of Related Art

Pumps are used to pump air into an object to be inflated and very common in different fields. A most commonly seen pump has a handle securely connected to a piston that is received in a tube. When the user moves the handle rearward relative to the tube, air is sucked into the tube. When the user pushes the handle, the piston forces the air sucked into and received in the tube out of the tube so as to accomplish the purpose of pumping air to the object. However, because the travel distance of the piston is short and the user can only force the air outward by pushing the piston forward, operation of the pump is very exhausting and labor inefficient.

In order to overcome the shortcoming of short travel distance of the piston, another pump is introduced to the market and has several tubes sequentially received in the other tubes so that the pump tubes are telescopic. When the tubes are extended and the handle is pushed, the piston inside the rearmost tube is driven to move to the frontmost tube so as to force the air out of the pump. Because the travel distance of the piston is increased, the quantity of air being forced out of the pump is accordingly increased when compared with a conventional one.

Either one of the pumps requires the user to move the handle backward to suck air into the pump so that the user is able to force the air out of the pump. That is, only when the piston is moving toward the frontmost tube, the air is forced to escape from the pump. Therefore, neither of the pumps enables the user to pump air outward from the pump no matter which direction the piston is moving so as to save energy for the user.

To overcome the shortcomings, the present invention tends to provide an improved telescopic dual movement pump to mitigate and obviate the aforementioned problems.

SUMMARY OF THE INVENTION

The primary objective of the present invention is to provide an improved telescopic dual movement pump, wherein the pump has a central tube, a first tube enclosing the central tube and movable relative to the central tube and a second tube enclosing the first tube and movable relative to the first tube so that the pump is telescopic.

Another object of the present invention is that a first piston assembly is provided to a distal end of the central tube and a second piston assembly is provided to a distal end of the first tube so that the movement of the first piston assembly as well as the second piston assembly is able to force air out of the pump from the central tube.

Still another objective of the present invention is to provide two deformable air pads so that no matter the second piston assembly is moving toward or away from the central tube, one of the air pads will have air tight engagement with an inner periphery of the second tube so as to force air into the central tube.

Other objects, advantages and novel features of the invention will become more apparent from the following detailed description when taken in conjunction with the accompanying drawings.

DETAILED DESCRIPTION OF THE PREFERRED EMBODIMENT

Figure 1:
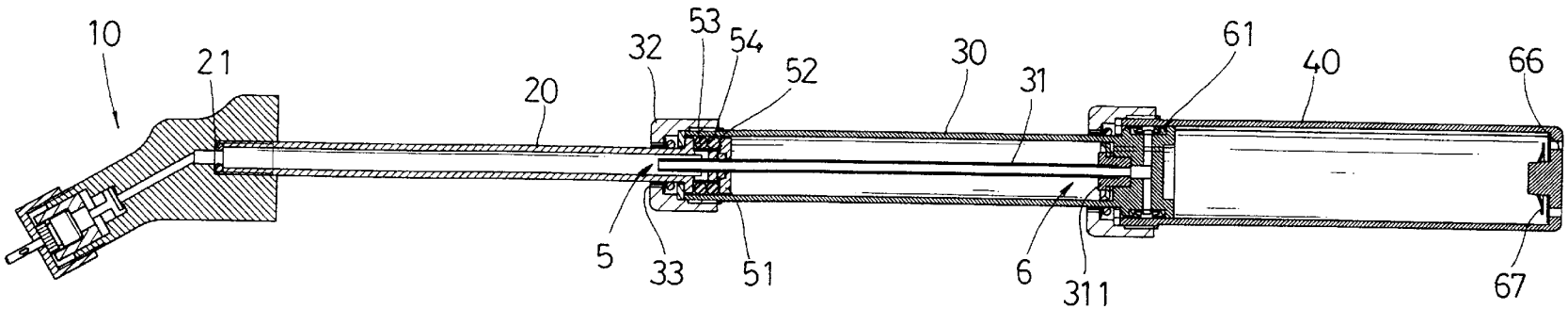
FIG. 1 is a cross sectional plan view of the telescopic dual movement pump of the present invention in fully extended status.

With reference to FIGS. 1, 2, 3 and 4, the telescopic dual movement pump in accordance with the present invention has a nozzle assembly (10) for discharging air out of the pump, a central tube (20), a first tube (30) enclosing the central tube (20) and movable relative to the central tube (20) and a second tube (40) enclosing the first tube (30) and movable relative to the first tube (30). A linking tube (31) is provided inside the first tube (30) to communicate the central tube (20) and the second tube (40).

The central tube (20) has a first air pad (21) securely mounted at a first distal end of the central tube (20) so as to have an air tight engagement with the nozzle assembly (10). A first piston assembly (5) is provided at a second distal end of the central tube (20) and has a block (51) integrally formed with the second distal end of the central tube (20), a recess (52) defined in the block (51) to receive therein a first seal (53) and a second seal (54) so as to have an air tight engagement with an inner periphery of the first tube (30) and a first passage (55) defined in a bottom defining the recess (52) to communicate with the central tube (20).

The first tube (30) has a first casing (32) formed on a first end thereof, an air channel (33) defined between the casing (32) and an outer periphery of the central tube (20) and a second air pad (34) received in the air channel (33) to selectively close and open the air channel (33). It is to be noted that the linking tube (31) extends through the block (51) and reaches an inside of the central tube (20) to communicate with the central tube (20). The linking tube (31) further has a first block (311) integrally formed with a distal end of the linking tube (31) and having a unidirectional valve (312) mounted on the first block (311) to have an air tight engagement with an inner periphery of the first tube (30). A second piston assembly (6) is formed on a second end of the first tube (30) and received in the second tube (40). The second piston assembly (6) includes a second block (61) integrally formed on the second end of the first tube (30), a cutout (62) peripherally defined in the second block (61), a first unidirectional valve (63) and a second unidirectional valve (64) both received in the cutout (62) and a second passage (65) defined between a bottom defining the cutout (62) to communicate the linking tube (31). The first unidirectional valve (63) has two extensions (631) and the second unidirectional valve (64) has two extensions (641). A gap (632,642) is defined between the two extensions (631, 641) respectively so that both the first and second unidirectional valves (63,64) are deformable.

The second tube (40) has a second casing (41) formed on a distal end connected with the end of the first tube (30), a first air channel (42) defined in a bottom of the second casing (41) and an outer periphery of the first tube (30) and a third air pad (43) received in the first air channel (42) to selectively control the opening and closing of the first air channel (42). Multiple holes (66) are defined in a bottom end of the second tube (40) to communicate the second tube (40) with the air outside the second tube (40) and a fourth unidirectional valve (67) is provided inside the second tube (40) to selectively control the opening and closing of the holes (66). A communication passage (68) is defined in the second block (61) to communicate the holes (66) with the first tube (30).

Figure 2:
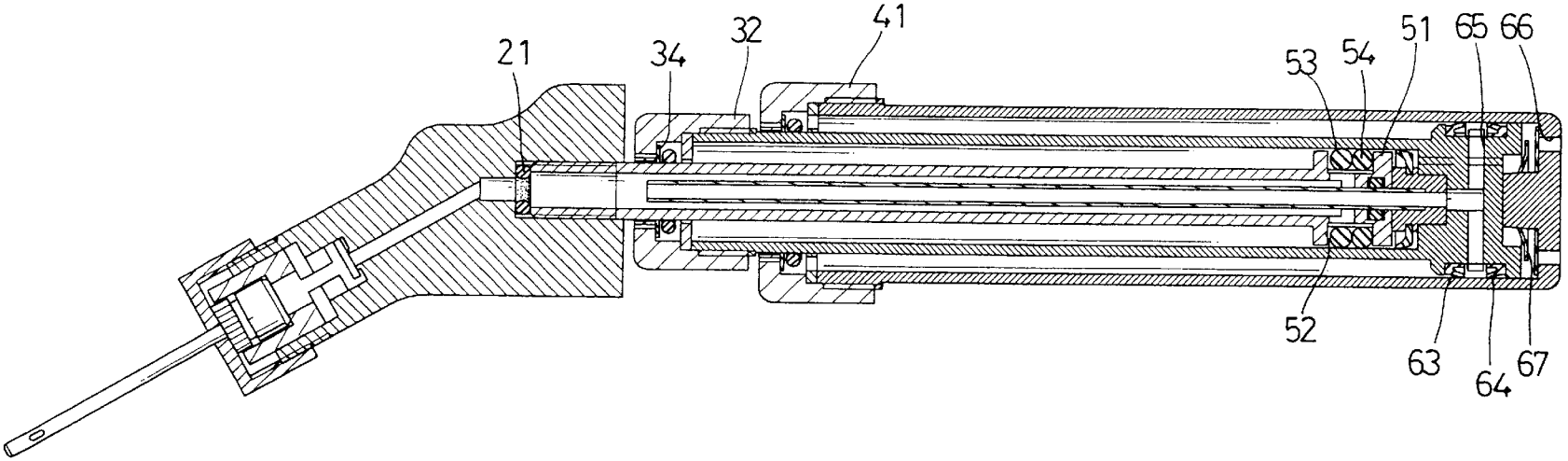
FIG. 2 is a cross sectional plan view of the telescopic dual movement pump of the present invention in fully contracted status.
Figure 4:
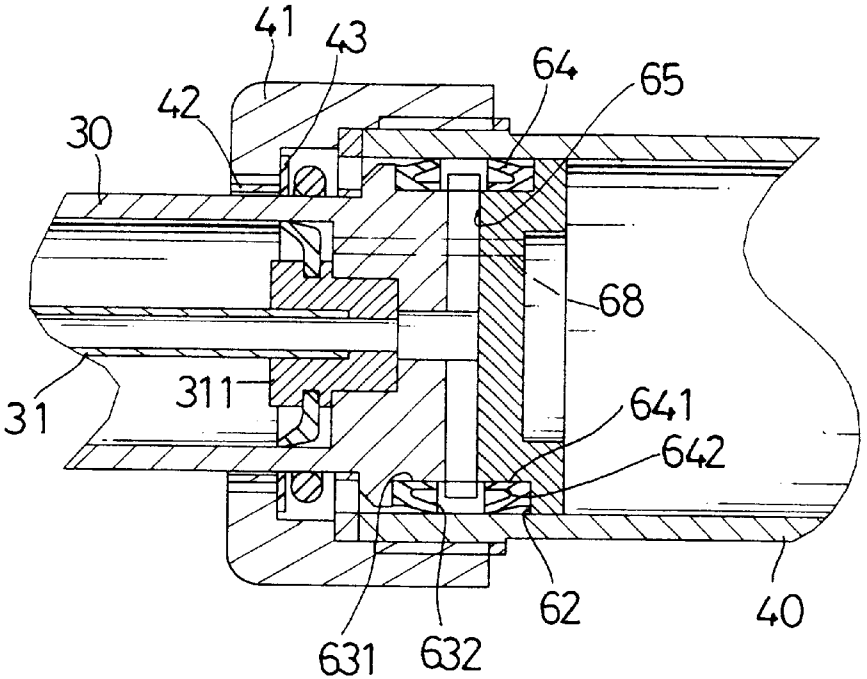
FIG. 4 is a partially enlarged cross sectional view showing the relationship between the second piston assembly and the second tube.
Figure 3:
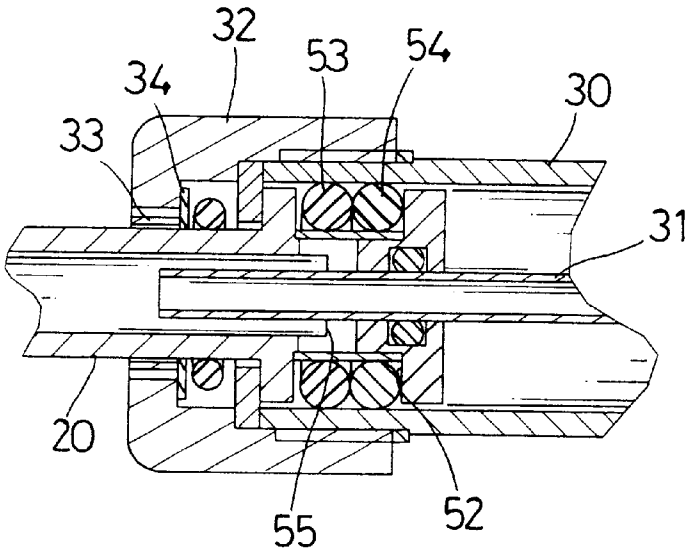
FIG. 3 is a partially enlarged cross sectional view showing the relationship between the central tube and the first tube.
Figure 5:
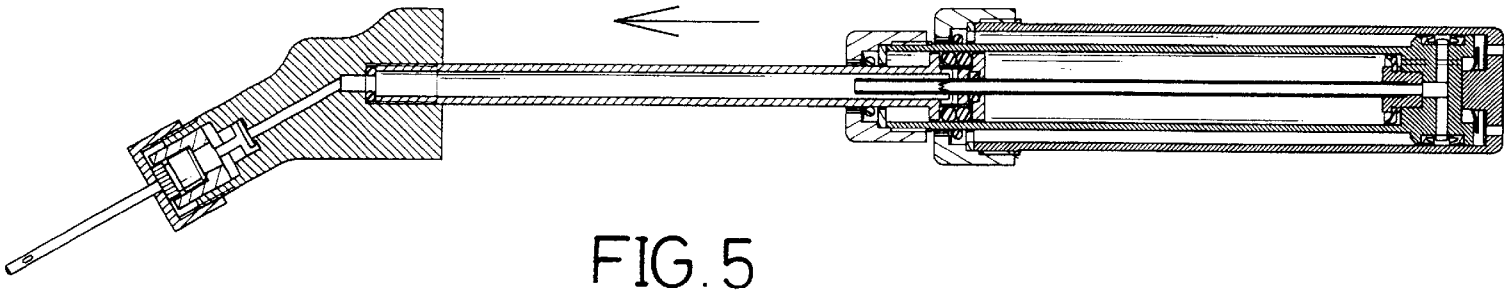
FIG. 5 is an operational view showing the movement of the first piston assembly in the first tube.

When the pump of the present invention is in operation, with reference to FIG. 5, the first piston assembly (5) of the pump is moved from the position shown in FIG. 2 toward the first casing (32), wherein it is to be noted that when the first piston assembly (5) leaves the second air pad (34), the second air pad (34) opens the air channel (33) to allow air to come into the room between the central tube (20) and the first tube (30). Therefore, when the first piston assembly (5) is moving toward the first casing (32), the air between the central tube (20) and the first tube (30) is forced to drive the second air pad (34) to close the air channel (34) and thus the compressed air between the central tube (20) and the first tube (30) passes through the first seal (53) and then enters the central tube (20) via the first passage (55) due to the blockage of the second seal (54) with the inner periphery of the first tube (30). After the air enters the central tube (20), the air is able to leave the pump from the nozzle assembly (10).

Meanwhile, the unidirectional valve (312) is opened by the vacuum effect caused by the movement of the first piston assembly (5) so that air is able to enter the second tube (40) from the holes (66), and thus the first tube (30) from the communication passage (68), to be ready for the following stroke. The movement of the first piston assembly (5) stops when the block (51) engages the second air pad (34).

Figure 6:
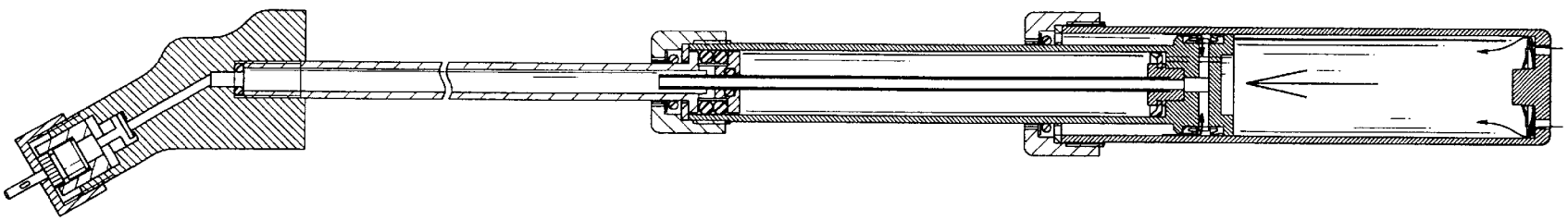
FIG. 6 is an operation view showing the movement of the second piston assembly in the second tube.

After the termination of the movement of the first piston assembly (5), if the second piston assembly (6) is moved toward the second casing (41), the air between the inner periphery of the second tube (40) and the outer periphery of the first tube (30) is compressed due to the movement of the second block (61). Furthermore, due to the movement of the second block (61), the fourth unidirectional valve (67) is driven to open the holes (66) by the vacuum effect caused by the movement of the second block (61) so that the ambient air outside the pump is able to flow into the second tube (40) as shown in FIG. 6.

When the second block (61) continues to move toward the second casing (41), the first unidirectional valve (63) is open and the second unidirectional valve (64) is closed so that the first air channel (42) is closed by the third air pad (43) because of the air compressed by the second block (61). Thus, the compressed air between the inner periphery of the second tube (40) and the outer periphery of the first tube (30) enters the second passage (65) and then the linking tube (31). After the air enters the linking tube (31) which communicates with the central tube (20), the air is forced out of the pump from the nozzle assembly (10).

Figure 7:
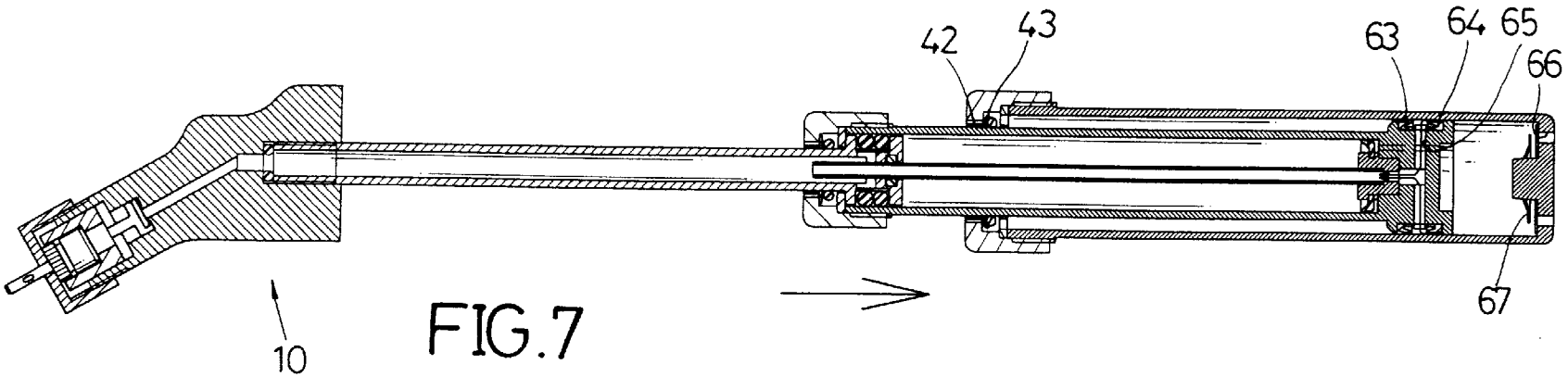
FIG. 7 is an operational view showing the movement of the first piston assembly in the first tube in a direction opposite to the direction as shown in FIG. 5.

With reference to FIG. 7, when the second block (61) moves to the holes (66), it is noted that the first unidirectional valve (63) is closed and the second unidirectional valve (64) is open. Meanwhile the fourth unidirectional valve (67) closes the holes (66) due to the air between the inner periphery of the second tube (40) and the outer periphery of the first tube (30) being compressed by the movement of the second block (61). The compressed air will then pass through the second unidirectional valve (64) and enter the second passage (65) and the linking tube (31). Eventually, the air will be ejected out of the pump from the nozzle assembly (10). While the second block (61) is moving away from the third air pad (43), the vacuum effect caused by the movement of the second block (61) away from the third air pad (43) drives the third air pad (43) to open the first air channel (42). Thus ambient air around the pump enters the room between the first tube (30) and the second tube (40) from the first air channel (42).

Figure 8:
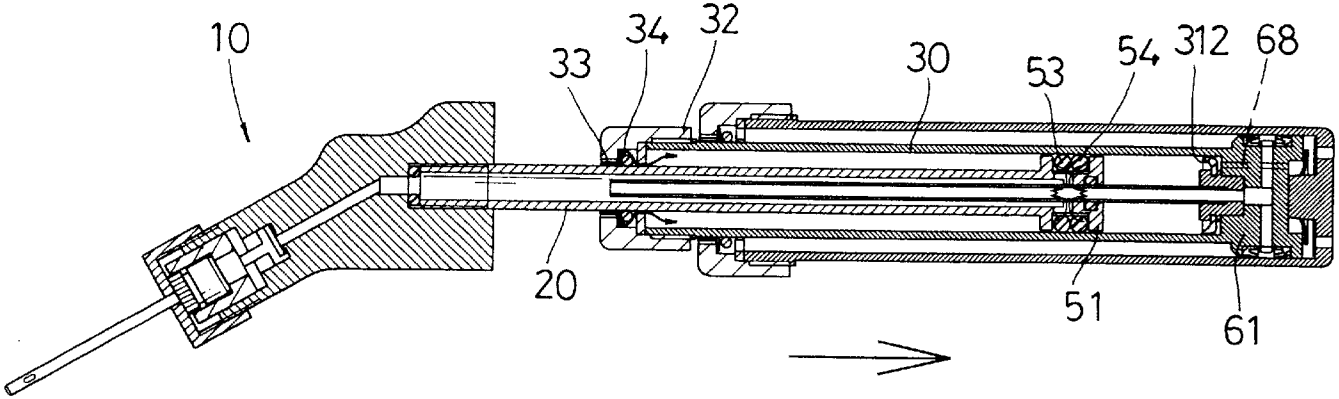
FIG. 8 is an operation view showing the movement of the second piston assembly in the second tube in a direction opposite to the direction as shown in FIG. 4.

With reference to FIG. 8, after the termination of the movement of the second block (61) by engaging with the distal end of the second tube (40), if the user continues to move the first piston assembly (5) away from the first casing (32), the second air pad (34) will open the air channel (33) due to the vacuum effect from the movement of the block (51). Thus the ambient air around the pump will enter the room between the central tube (20) and the first tube (30). However, when the block (51) is moving toward the second block (61), the air inside the first tube (30) will be compressed and thus drives the unidirectional valve (312) to close the communication passage (68). Due to the blockage of the communication passage (68) by the unidirectional valve (312), the communication between the first tube (30) and the second tube (40) is terminated. Therefore, the compressed air inside the second tube (40) passes the second seal (54) and enters the first passage (55) and thus the central tube (20). Eventually, the air is ejected from the nozzle assembly (10).

From the foregoing description, it is noted that the movements of both the block (51) and the second block (61) in two opposite directions will eject air out of the pump so that the pump of the present invention is labor efficient. Further, the central tube (20) is able to be received in the first tube (30) which is able to be received in the second tube (40) so that the pump of the present invention is telescopic and thus the size is compact for storage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pump comprising a nozzle assembly, a central tube in communication with the nozzle assembly, a first tube enclosing the central tube and being slidable relative to the central tube and a second tube enclosing the first tube and being slidable relative to the first tube, wherein the central tube has a first end received in the nozzle assembly and provided with a first air pad so that the central tube is able to have an air tight engagement with the nozzle assembly and a second end received in the first tube and having a first piston assembly, the first piston assembly being provided with a block slidably received in the first tube and having a recess in the block to receive therein a first seal and a second seal so as to have an air tight engagement with an inner periphery of the first tube, a first passage defined in a bottom defining the recess to communicate with the central tube, the first tube having a first casing securely formed on a first end of the first tube to enclose the second end of the central tube, an air channel defined between the first casing and an outer periphery of the central tube, a second air pad received in the air channel to selectively control air flowing into the air channel and a room defined between the inner periphery of the first tube and the outer periphery of the central tube, the improvements comprise:

the first tube has a second end provided with a second piston assembly which includes a second block slidably received in the second tube and the second tube has a second casing enclosing the second block, a first air channel is defined between the second casing and the first tube to receive therein a third air pad to selectively control air flowing to a room between the first tube and the second tube when the second piston assembly moves, and the second block has a cutout to receive therein a first unidirectional valve and a second unidirectional valve whereby the second piston assembly forms an air tight engagement with an inner periphery of the second tube, a second passage being defined in a bottom defining the cutout to communicate with a linking tube which is located in the first tube to communicate the second tube to the central tube.

2. The pump as claimed in claim 1, wherein the first unidirectional and the second unidirectional valve respectively have two extensions and a gap between the two extensions so that both the first unidirectional valve and the second unidirectional valve are deformable when the second block moves.

3. The pump as claimed in claim 2, wherein the linking tube has a first block located in the first tube and having a unidirectional valve.

4. The pump as claimed in claim 3, wherein the second tube has a second end provided with holes and fourth unidirectional valve to selectively control air flowing into the second tube from the holes when the second block moves, and a communication passage is defined in the second block to communicate the first tube and the second tube, the unidirectional valve selectively controls air flowing through the communication passage due to movement of the first piston assembly.

5. The pump as claimed in claim 1, wherein the linking tube has a first block located in the first tube and having a unidirectional valve.

6. The pump as claimed in claim 1, wherein the second tube has a second end provided with holes and fourth unidirectional valve to selectively control air flowing into the second tube from the holes when the second block moves.

7. A pump comprising:

a nozzle assembly;

a central tube in communication with the nozzle assembly and having a first air pad to have an air tight engagement with the nozzle assembly;

a first tube enclosing the central tube and being slidable relative to the central tube, wherein the central tube has a first piston assembly integrally formed on a distal end of the central tube and received in the first tube; and a second tube enclosing the first tube and being slidable relative to the first tube, the second tube having a second casing enclosing a second piston assembly which is integrally formed on a distal end of the first tube and has a second block movably received in the second tube, a first air channel defined between the second casing and an outer periphery of the first tube to receive therein a third air pad so as to control air flowing to a room defined between the first tube and the second tube when the second piston moves, the second block having a cutout to receive therein a first unidirectional valve and a second a second passage being defined in a bottom defining the cutout to communicate with a linking tube which is received in the first tube to communicate the second tube to the central tube.

8. The pump as claimed in claim 7, wherein the first piston assembly has a block movably received in the first tube and having a recess defined in the block to receive therein a first seal and a second seal so that the central tube is able to have an air tight engagement with the first tube, a first passage is defined in a bottom defining the recess so as to have communication with the central tube, the first tube has a first casing enclosing the first piston assembly, an air channel defined between the first casing and an outer periphery of the central tube to receive therein a second air pad so that the second air pad is able to selectively control air flowing to a room defined between the central tube and the inner periphery of the first tube.

9. The pump as claimed in claim 8, wherein each of the first and second unidirectional valves has two extensions and a gap defined between the two extensions so that both the first unidirectional valve and the second unidirectional valve are deformable.

10. The pump as claim in claim 9, wherein the linking tube has a first block and a unidirectional valve on the first block to have an air tight engagement with the inner periphery of the first tube.

11. The pump as claimed in claim 10, wherein the second tube has a second end provided with holes and a fourth unidirectional valve to selectively control air flowing into the second tube from the holes when the second block moves, and a communication passage is defined in the second block to communicate the first tube and the second tube, the unidirectional valve selectively controls air flowing through the communication passage due to movement of the first piston assembly.

12. The pump as claimed in claim 8, wherein the linking tube has a first block and a unidirectional valve on the first block to have an air tight engagement with the inner periphery of the first tube.

13. The pump as claimed in claim 7, wherein the second tube has a second end provided with holes and fourth unidirectional valve to selectively control air flowing into the second tube from the holes when the second block moves, and a communication passage is defined in the second block to communicate the first tube and the second tube, the unidirectional valve selectively controls air flowing through the communication passage due to movement of the first piston assembly.

* * * * *